US005785193A

United States Patent [19]

Kobayashi et al.

[11] Patent Number: 5,785,193

[45] Date of Patent: Jul. 28, 1998

[54] SNAP-HINGED CAP

[75] Inventors: Tsutomu Kobayashi; Tsugio Arai, both of Ibaraki, Japan

[73] Assignee: Yoshino Kogyosho Co., Ltd., Tokyo, Japan

[21] Appl. No.: 601,644

[22] Filed: Feb. 14, 1996

[30] Foreign Application Priority Data

Feb. 15, 1995 [JP] Japan ..... 7-050482

[51] Int. Cl.[6] ..... B65D 43/14

[52] U.S. Cl. ..... 215/235; 215/237; 220/389; 16/227

[58] Field of Search ..... 215/235, 237; 220/339, 335, 337; 16/227

[56] References Cited

U.S. PATENT DOCUMENTS

| | | | |
|---|---|---|---|
| 3,629,901 | 12/1971 | Wolf | 16/227 |
| 3,933,271 | 1/1976 | McGhie | 16/227 X |
| 4,615,462 | 10/1986 | Sacherer et al. | 16/227 X |
| 4,813,560 | 3/1989 | Begley | 215/235 |
| 5,148,912 | 9/1992 | Nozawa | 215/235 X |
| 5,361,920 | 11/1994 | Nozawa et al. | 215/235 X |
| 5,435,456 | 7/1995 | Dubach | 215/235 X |
| 5,489,035 | 2/1996 | Fuchs | 215/235 |

FOREIGN PATENT DOCUMENTS

| | | | |
|---|---|---|---|
| A-0 590 325 A2 | 4/1994 | European Pat. Off. . | |
| A-0 608 755 A1 | 8/1994 | European Pat. Off. . | |
| 1228265 | 8/1960 | France | 220/339 |
| 3321000 | 12/1984 | Germany | 16/227 |
| Wo 94/22732 | 10/1994 | WIPO . | |

*Primary Examiner*—Allan N. Shoap
*Assistant Examiner*—Nathan Newhouse
*Attorney, Agent, or Firm*—Oliff & Berridge

[57] ABSTRACT

A snap-hinged cap includes a main body section of thermoplastic synthetic resin, a cap integrally molded with the main body section, a film hinge connecting the main body section and the cap, and straps arranged on both lateral sides of the film hinge. The straps are connected to the main body section and the cap at connecting sections. Each of the straps has a center line longer than a straight line between the connecting sections. The skirt section of the cap has a peripheral wall which includes a thin portion located adjacent to the film hinge and the straps and a remaining portion.

8 Claims, 15 Drawing Sheets

SNAP-HINGED CAP

BACKGROUND OF THE INVENTION

This invention relates to an improved snap-hinged cap be mainly used to close and open a liquid discharge opening with a snap motion.

A snap-hinged cap used to close and open a liquid discharge opening is already known from Japanese Patent Publication No. 3-53182.

As shown in FIG. 18, a snap-hinged cap disclosed in the above patent publication is provided with a film hinge A and a pair of straps B arranged along the respective lateral sides of and slightly below the film hinge. Thus, the film hinge and the straps mutually connect a main body section C and a cap D.

However, with a snap-hinged cap having a configuration as described above, the straps B are made substantially straight when the cap D is opened. Although the straps B have a length shorter than the arc traced by the cap D when it is swung open or closed, the straps expand to operate as springs when the straps are moving so that they are held under stress when the cap D is in an intermediary position between the closed position and the opened position.

More specifically, with a snap-hinged cap as disclosed in the above patent publication and illustrated in FIG. 18, each of the points F connecting the respective straps B and the cap D traces an arc E as the cap D swings around the axis 0 of swinging motion of the film hinge A.

On the other hand, as the cap D swings, the straps B swing around the respective points G connecting the straps and the main body section C so that the connection points flare supposed to trace respective arcs H as free ends.

However, in reality, the connecting points move with the cap D and traces respective arcs E to expand the strap B by a distance E.

For each of the straps B, the distance E of expansion is a sum of an amount L1 of deformation of the strap B at the connecting points F and G where it is hooked and an amount L2 of expansion of the strap B that gives rise to the above spring effect.

When the cap D takes its closed position relative to the main body section C, the strap B are held to a curved state as indicated by broken lines I in FIG. 18.

In order to generate the amount L2 of expansion, only the straps B have to be subjected to strong external tensile force repeatedly so that they may lose their mechanical strength, with their surface layers getting exfoliated with time, until they eventually break down.

SUMMARY OF TEE INVENTION

In view of the above identified problem of known snap-hinged caps, it is therefore an object of the present invention to provide a snap-hinged cap comprising straps that are not subjected to strong external tensile force and hence not accompanied by the problem of losing their mechanical strength and producing exfoliated surface layers, if the cap is repeatedly opened and closed, so that the snap-hinged cap can maintain its snap effect without requiring the use of a complicated structure and that of synthetic resin by an increased amount and affecting adversely to capping, packaging and related operations.

In order to solve the above problem, according to the invention, there is provided a snap-hinged cap comprising a main body section of thermoplastic synthetic resin, a cap integrally molded with the main body section, a film hinge connecting the main body section and the cap, and straps arranged on both lateral sides of the film hinge, wherein the cap includes a skirt section which includes a lower edge, the main body section includes a peripheral wall, the film hinge connects a portion of the lower edge of the skirt section of the cap and the peripheral wall of the main body section, the straps are connected to the main body section and the cap at connecting sections, the connecting sections being arranged above and below an abutting surface of the lower edge of the skirt section of the cap and the main body section in case of the cap being closed, each of the straps having a center line longer than a straight line between the connecting sections, and the skirt section of the cap having a peripheral wall which comprises a thin portion located adjacent to the film hinge and the straps and a remaining portion.

According to the invention, since each of the straps connecting the main body section and the cap and arranged along the respective lateral sides of the film hinge has a center line longer than the straight line between the opposite ends thereof connected respectively to the main body section and the cap and the skirt section of the cap has a peripheral wall having a wall thickness reduced in portions located adjacent to the film hinge and the respective straps from the wall thickness in the remaining portion, the situation where the straps are made short and not sufficient to accommodate the swinging motion of the cap and the insufficiency in the length of the straps is compensated by elastic deformation of the straps and that of the thin areas of the skirt section to make the film hinge and the straps subjected to excessive external tensile force as in the case of conventional snap-hinged caps is effectively prevented and the straps show elastic resiliency to give rise to a good snap effect.

Each of the straps may have a compressed V-shaped lateral view and a bent section. The bent section is projected toward a center of the cap when the-cap is closed, and the bent section is projected upwardly when the cap is opened. Since each of the straps shows a mildly V-shaped lateral view, it can be easily extended and elastically deformed to stretch itself into a straight form. Additionally, since the bent sections of the mildly V-shaped straps project toward the central axis of the cap when the cap is closed, the portions of the straps projecting outward from the outer peripheral surface of the snap-hinged cap can be dimensionally minimized.

Each of the straps may have the largest thickness at the respective bent sections of compressed V-shape. Since the straps have the largest thickness at the respective bent sections of their mild V-shapes, they show a strong elastic resiliency when they are elastically deformed and stretched into an almost straight form.

The thin portion may include a transversal cross sectional view concaved toward a center of the cap. Since each of the portions of the skirt section of the cap formed outside the straps and having a reduced thickness comprises a peripheral wall section having a transversal cross sectional view concaved toward the center of the cap, those portions can be easily and elastically deformed to reduce any external tensile force to which the straps are subjected.

The skirt section of the cap may include a thin portion. The thin portion comprises an inner peripheral wall having a transversal cross sectional view convexed outwardly and formed on an inner peripheral wall of the skirt section, and an outer peripheral surface which is continuously and smoothly extending from an outer peripheral surface of the skirt section. Since each of the portions of the skirt section of the cap formed outside the straps and having a reduced thickness comprises a peripheral wall section having a transversal cross sectional view convexed toward the center of the cap and an outer peripheral surface continuously and smoothly extending from the outer peripheral surface of the remaining portion of the skirt section, the snap-hinged cap provides a good appearance and can adapt itself stably to bottling operation in a bottling line using a hopper to enhance the rate of bottling operation.

The thin portion may include a thin peripheral wall section having a transversal cross sectional view concaved toward a center of the cap, and a notch provided opposite to the straps relating to the thin peripheral wall section. Since each of the portions of the skirt section of the cap formed outside the straps and having a reduced thickness makes the outer peripheral surface of the cap transversally longer to a certain extent than other embodiments of a snap-hinged cap, the snap-hinged cap can adapt itself more stably to bottling operation in a bottling line and the resiliency of the portions of the skirt section having a reduced thickness can be improved to some extent.

The peripheral wall of the main body section may have a cylindrical shape, and the skirt section of the cap may have a cylindrical shape. The skirt section has thin peripheral wall sections. Connecting portions of the hinges and the skirt section, an axis of rotating motion of the film hinge and the thin peripheral wall sections are arranged near an imaginary extended surface of the peripheral wall and an imaginary extended surface of a thicker peripheral wall sections of the skirt section. Since only a couple of members project by a short distance from the outer peripheral surface of the cylindrical container comprising a main body section and a cap as integral components when the cap is in its closed position, the container can adapt itself excellently to packaging operation.

When the cap is opened and closed, the thin peripheral wall sections are elastically deformed to prevent the film hinge and the straps from being subjected to concentrated tensile stress. The skirt section is elastically deformed to absorb and dissipate external tensile force applied to the straps and eliminate any tensile stress in the straps at an angular position of the cap where the straps are maximally expanded.

PREFERRED EMBODIMENT OF THE INVENTION

Figure 1:
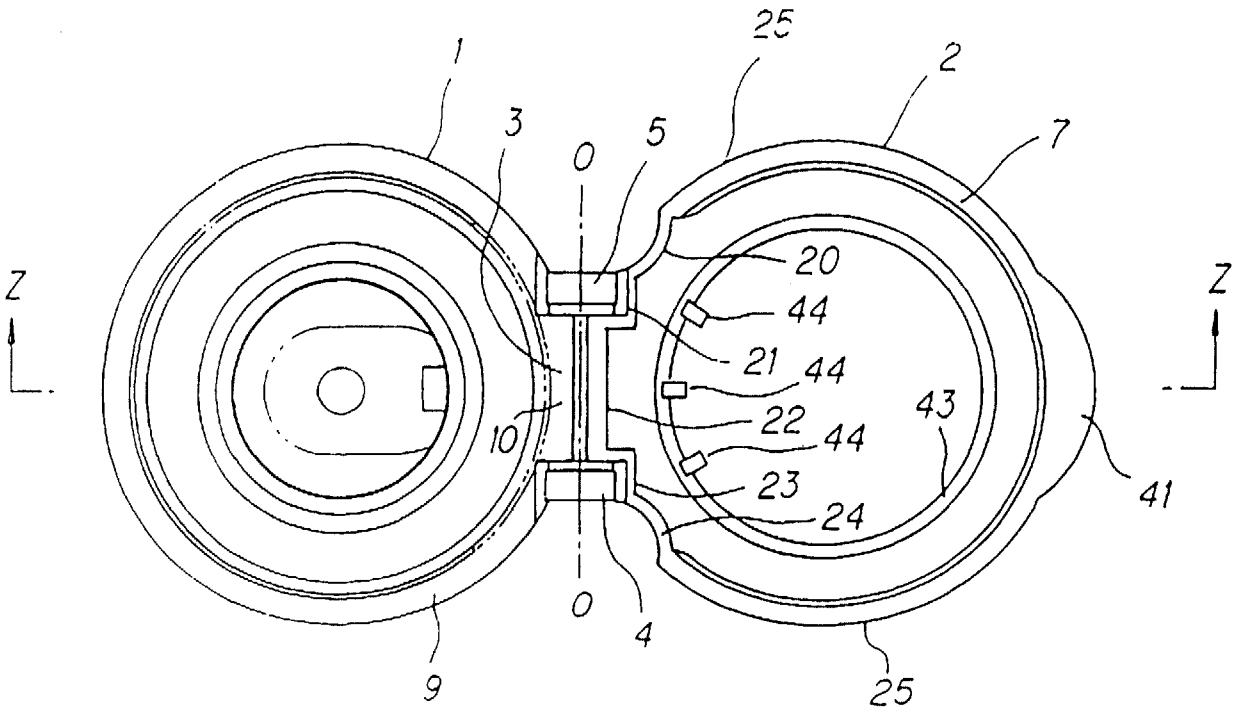
FIG. 1 is an enlarged plan view of a first embodiment of the invention with a cap in its open position.

FIGS. 1 through 11 illustrate a first embodiment of the invention, although the profile and the dimensions are not limited to the embodiment..

The illustrated embodiment of snap-hinged cap is designed to snap fit onto a circular neck 28 of a liquid container. As shown in FIGS. 1, 2, 3 and 4, a snap-hinged cap comprises a main body section 1 of thermoplastic resin such as polyethylene, a cap 2 integrally formed and molded with the main body section 1, a film hinge 3 connecting the main body section 1 and the cap 2, and the straps 4, 5 arranged on both lateral sides of the film hinge 3.

The cap 2 has a skirt section 6 which has a lower edge 7. The main body section 1 has a peripheral wall 8 which has an upper edge 9. When the cap 2 is closed, the lower edge 7 of the cap 2 abuts the upper edge 9 of the main body section 1. The film hinge 3 has an upper surface 10 and a lower surface of a recessed section 11 having an inverted V-shape. The upper surface 10 of the film hinge 3 is located exactly on a plane where the lower edge 7 of the cap 2 abuts the upper edge 9 of the main body section 1.

Figure 4:
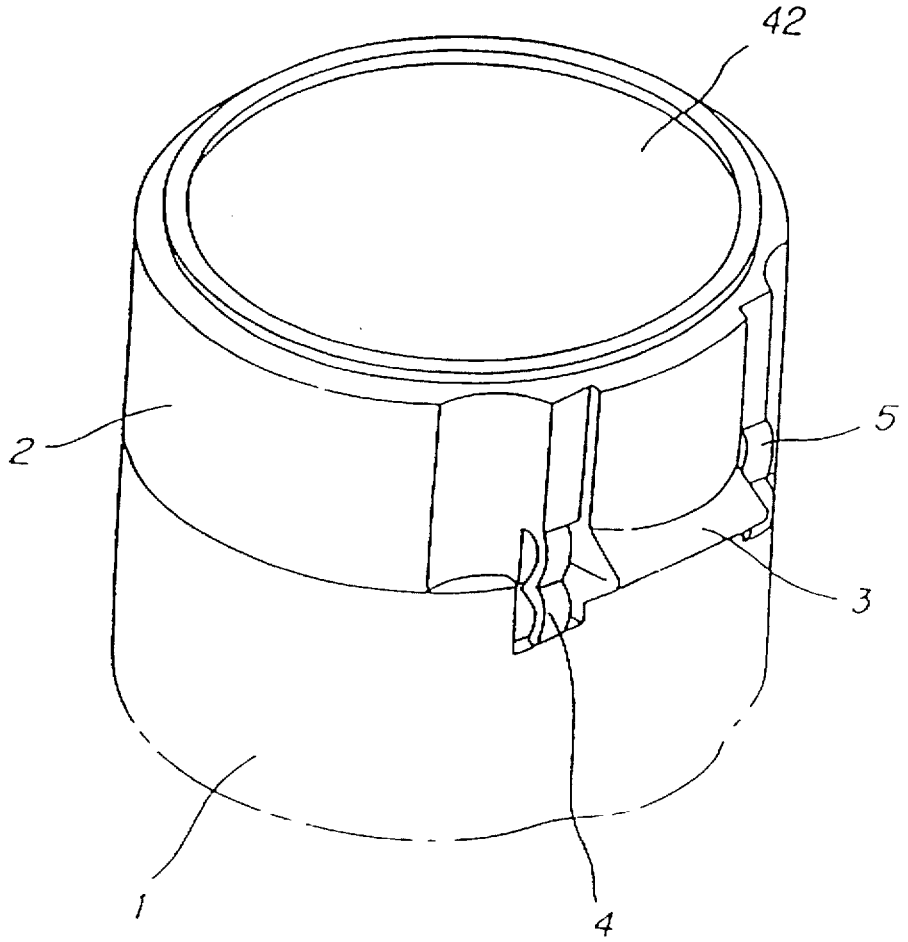
FIG. 4 is a perspective view of the cap of the embodiment of FIG. 1 in its closed position.
Figure 5:
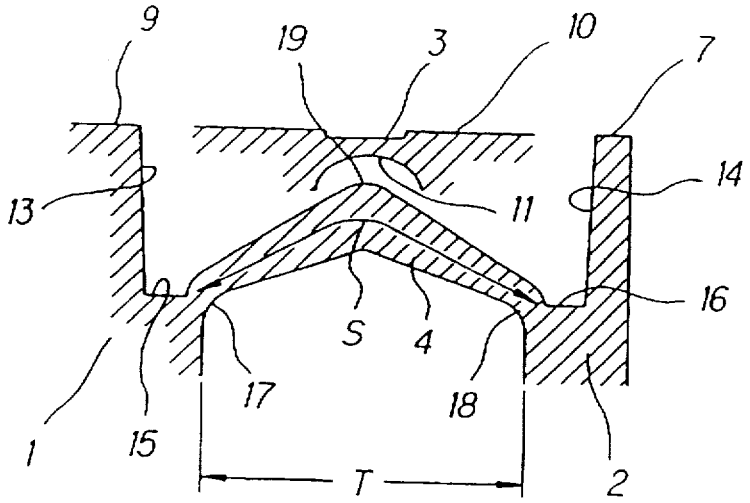
FIG. 5 is an enlarged cross sectional partial view of the embodiment of FIG. 4, showing the relationship between the film hinge and the straps.
Figure 6:
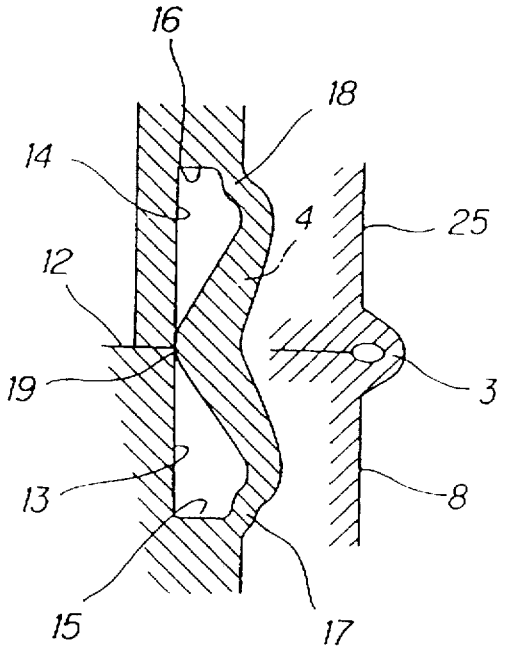
FIG. 6 is an enlarged cross sectional partial view of the embodiment of FIG. 4, showing the relationship between the film hinge and the straps.

The peripheral wall 8 of the main body section 1 has a recessed section 13 including an end 15, and the lower edge 7 of the cap 2 has a recessed section 14 including an end 16. The recessed section 13 has a depth same as that of the recessed section 14. As illustrated in FIGS. 4, 5 and 6, each of the straps 4, 5 has a connecting section 17, 18 and a bent section 19. Each of the straps 4, 5 is connected to the main body section 1 and the cap 2 at the ends 15, 16 with the connecting sections 17, 18. The ends 15, 16 and the connecting sections 17, 18 are located above and below an abutment plane 12 in which the lower edge 7 of the cap 2 abuts the upper edge 9 of the main body section 1.

Each of said straps 4, 5 has a center line having a length S that is longer than the length T of a straight line connecting said connecting sections 17, 18.

As apparent from FIGS; 5 and 6, each of the straps 4, 5 has a compressed V-shaped lateral view. When the cap 2 is opened, the bent section 19 is projected upwardly. When the cap 2 is closed, the bent section 19 is projected toward a center of the cap. Each of the straps 4, 5 is realized in the form of a rather thick band as a whole, and has the largest thickness at the bent section 19 and the thickness is reduced toward the connecting sections 17, 18.

Figure 2:
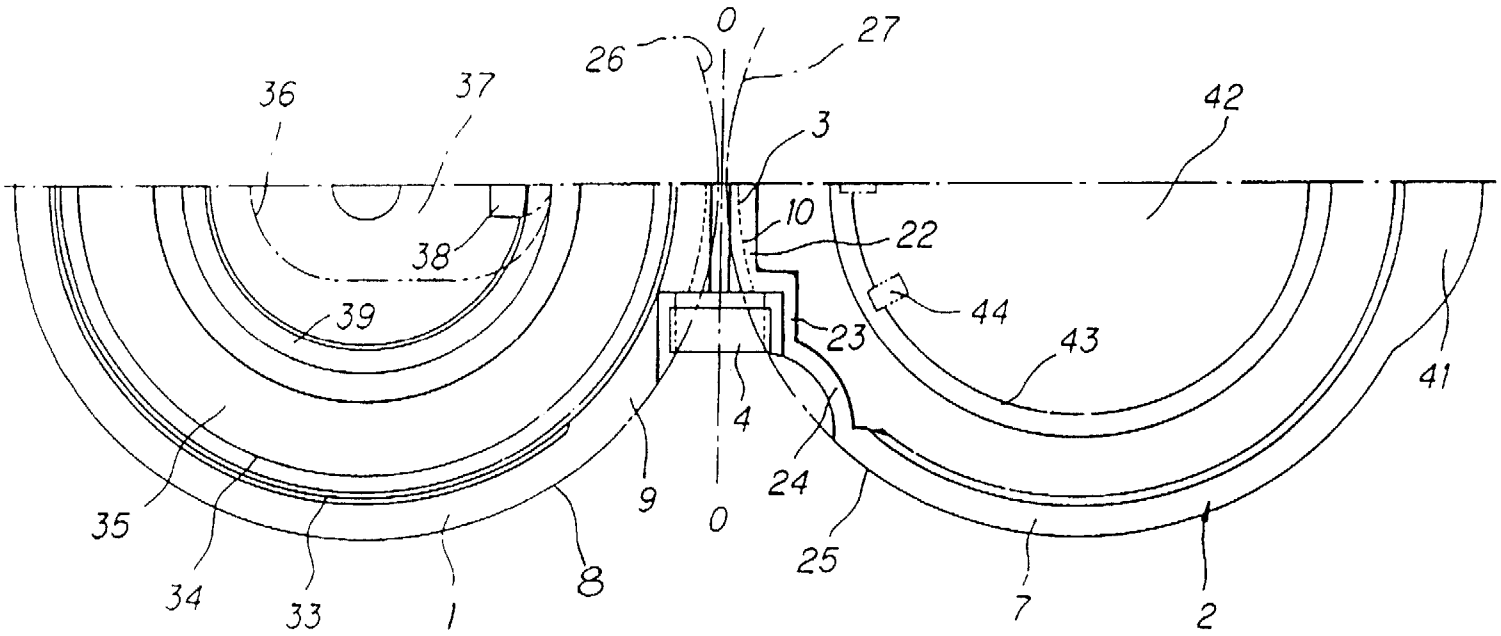
FIG. 2 is a further-enlarged plan view of a half of the embodiment of FIG. 1.
Figure 3:
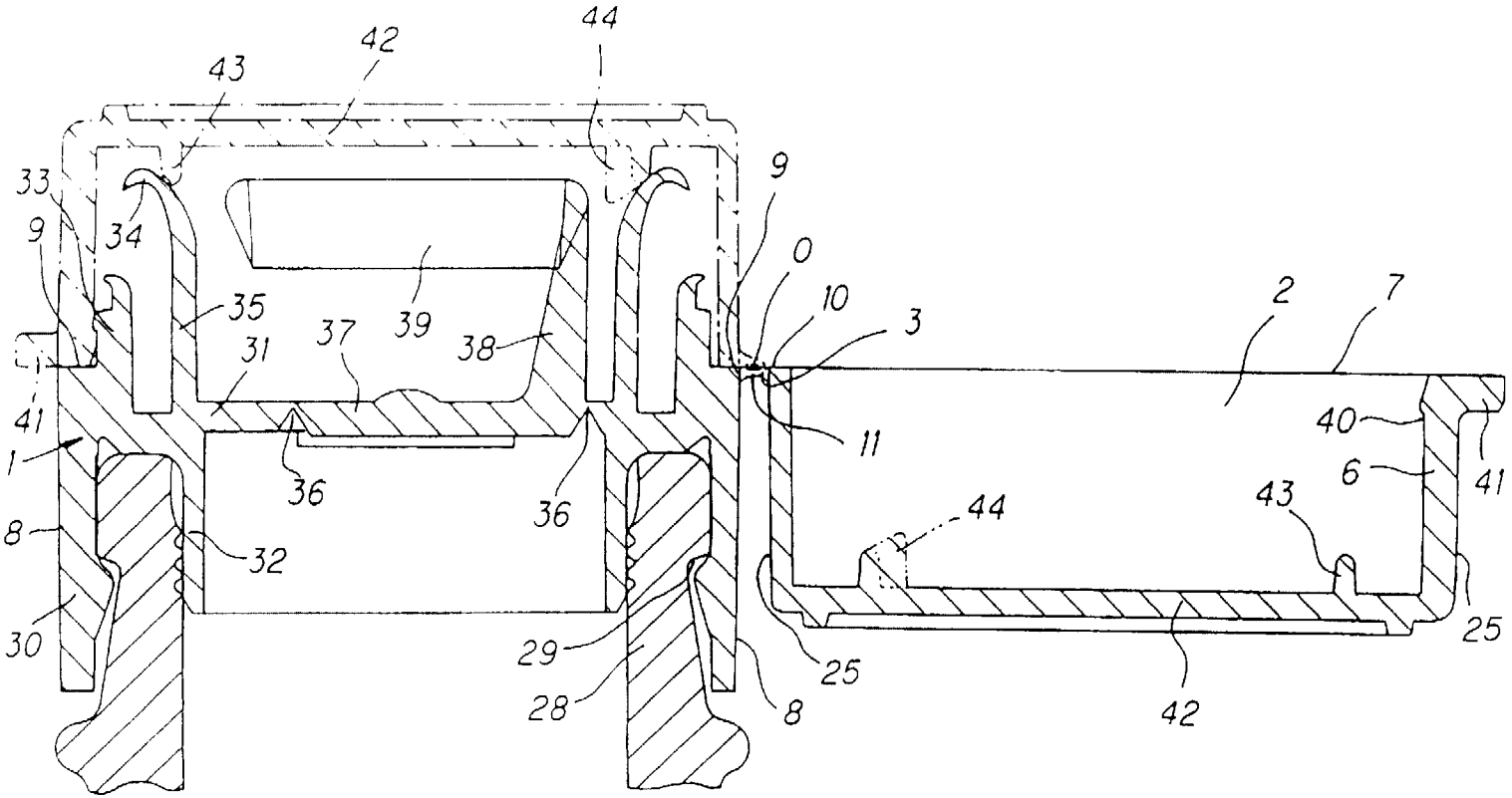
FIG. 3 is an enlarged cross sectional view of the embodiment of FIG. 1 taken along line Z—Z in FIG. 1.

As clearly seen from FIGS. 1, 2 and 3, said skirt section 6 of the cap 2 has peripheral wall sections 20, 21, 22, 23 and 24 located near a connecting portion of the cap 2, the film hinge 3 and the straps 4, 5 and a remaining peripheral wall section 25. The peripheral wall sections 20, 21, 22, 23 and 24 near the connecting portion has a thickness smaller than that of the remaining peripheral wall section 25 so that they are apt to be elastically deformed by radial pressure applied thereto.

In particular, each of the peripheral wall sections 20, 24 located outside the respective connecting portion of the film hinge 3 and the straps 4, 5 along an outer periphery of the cap 2 has a transversal cross sectional view concaved toward the center of the cap so as to concentrate the deformation due to the radial pressure on and near the connecting portion.

As illustrated in FIG. 2, an axis 0—0 of swinging motion of the film hinge 3 is located close to an imaginary extended surface 26 of the peripheral wall 8 of the main body section 1 and an imaginary extended surface 27 of the peripheral wall sections 25 of the skirt section 6. The peripheral wall sections 20, 21, 22, 23 and 24 having a reduced thickness of the skirt section 6 and the connecting sections 17, 18 of the straps 4, 5 are located inside the imaginary extended surfaces 26, 27 of the peripheral walls with regard to the center of the main body section 1 and that of the cap 2.

The main body section 1 is engagedly fitted onto the neck 28 of a liquid container and comprises a lower cylindrical section 30 secured to an undercut section 29 of the neck, a top wall 31 and an inner cylindrical section 32 extending downwardly from the top wall 31 and tightly held to an inner surface of the mouth-neck section 28.

An annular wall 33 is standing from an upper surface of the top wall 31 and near the outer periphery of the top wall 31 and the upper edge 9 of the peripheral wall 8 of the main body section 1 is located outside an outer peripheral surface of the annular wall 33.

A discharge cylinder 35 having a liquid discharging annular lip 34 is standing from the upper surface of the top wall 31 and at the inside of the annular wall 33.

The top wall 31 is additionally provided with an easily breakable and annularly V-grooved notch 36 in the inside of the discharge cylinder 35. An easily removable portion 37 surrounded by the notch 36 is provided with a leg piece 38 and a tongue piece 39.

The skirt section 6 of said cap 2 is engaged with the annular wall 33 of the main body section 1. The skirt section 6 has an inner diameter which is so arrange that an undercut section 40 of the cap 2 is detachably engaged with the annular wall 33 of the main body section 1. The cap 2 is provided with a finger hook 41 for opening the cap with a finger tip. The finger hook 41 is outwardly projected from the outer periphery of the skirt section 6 at a position radially opposite to the film hinge 3.

The cap 2 has a top wall 42. An inner surface of the top wall 42 is provided with an annular rim 43 and an appropriate number of small aligning projections 44 which are projected from the top wall 42. The annular rim 43 is so designed to abut the inner surface of the annular lip 34 of said discharge cylinder 35 of the main body section 1 in order to prevent liquid from leaking therethrough. The small aligning projections 44 are so designed to abut the inner surface of the annular lip 34 in order to align the skirt section 6 of the cap 2 with the annular wall 33 of the main body section 1 as the former is fitted onto the latter.

The first embodiment of the invention has a configuration as described above and operates in a manner as described below by referring to FIGS. 7 through 11.

Figure 7:
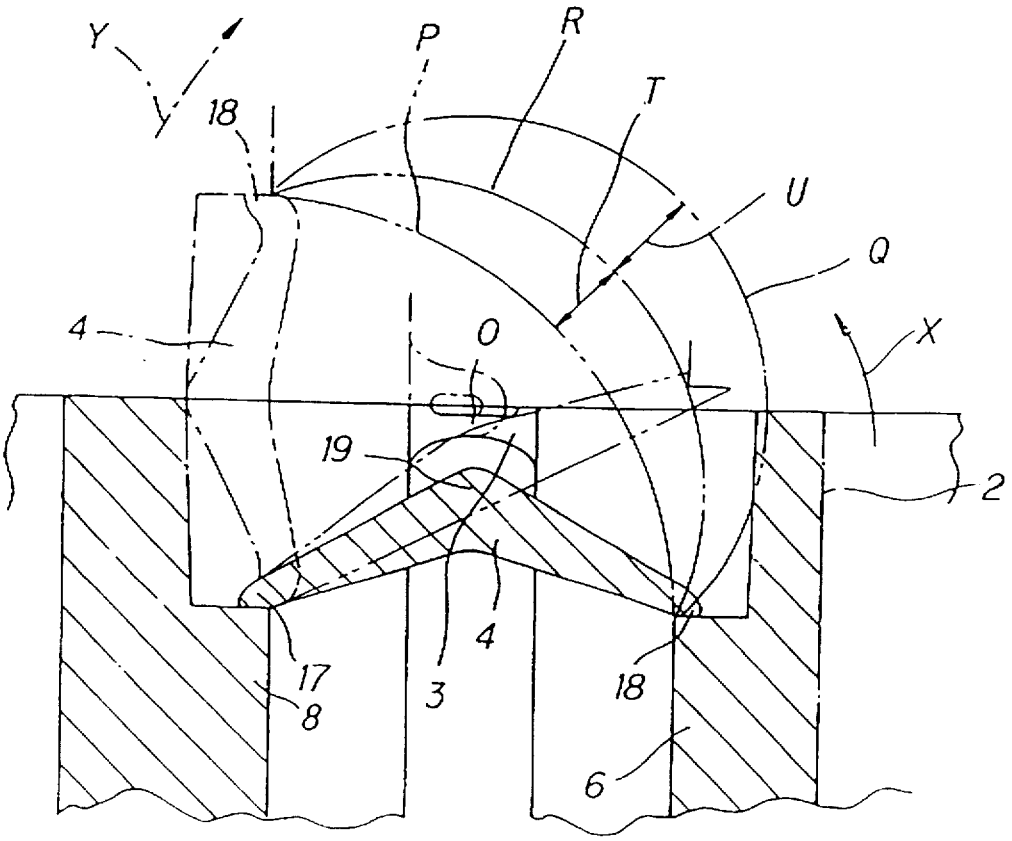
FIG. 7 is an illustration showing loci of straps according to the invention.

When the cap 2 is in an open position as indicated by solid lines in FIG. 7, the film hinge 3 is flat and the strap 4 is held stationary with the bent section 19 facing upward.

When the cap 2 is turned toward to its closed position as indicated by arrow X in FIG. 7, the cap swings or rotates around the axis 0—0 of swinging motion of the film hinge 3. The connecting section 18 connecting the strap 4 and the skirt section 6 of the cap 2 rotates around the connecting section 17 (connecting the strap 4 and the peripheral wall 8 of the main body section 1) as a pivot.

If the connecting section 18 of the strap 4 is a free end, the connecting section 18 would draw a locus of rotation P as it rotates. If the connecting section 17 of the strap 4 is a free end, the connecting section 18 would draw a locus of rotation Q as it rotates.

However, since both the connecting sections 17, 18 are connected to the main body section 1 and the cap 2, the rotary motion of the strap 4 is restrained curbed by the skirt section 6 of the cap 2 to such a motion as described below.

Namely, as the cap 2 swings further, the curved connecting sections 17, 18 of the strap 4 and the bent section 19 are elastically deformed to eventually become substantially straight and make the strap 4 longer by distance T shown in FIG. 7.

However, since the strap is still short of the required length with regard to the locus of rotation Q by distance U indicated in FIG. 7, the skirt section 6 of the cap 2 is subjected to tensile force trying to compensate the distance U or the shortage of length.

Figure 8:
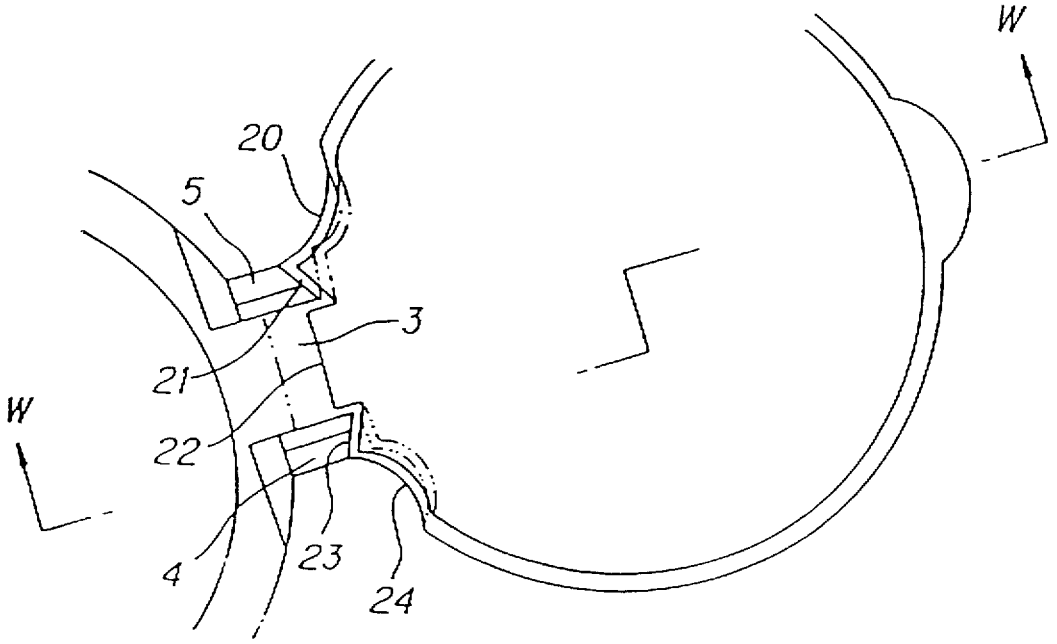
FIG. 8 is an enlarged schematic plan view of a snap-hinged cap according to the invention, showing a film hinge and portions of the skirt section to which respective straps are connected to illustrate how these components are elastically deformed when the cap starts swinging.
Figure 9:
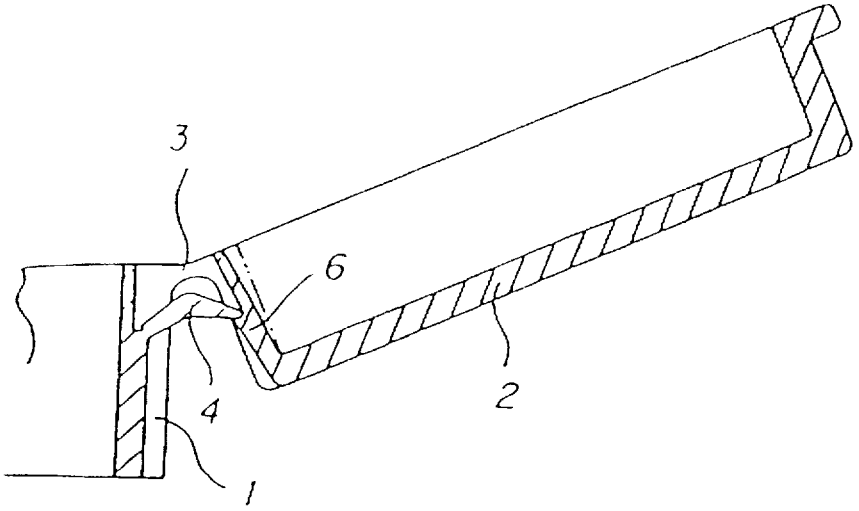
FIG. 9 is a schematic cross sectional view taken along line W—W in FIG. 8.

This tensile force acts on the peripheral wall sections 20, 21, 22, 23 and 24 to elastically deform them in the outward direction of the skirt section 6 as indicated by solid lines in FIGS. 8 and 9.

The elastic outward deformation of the peripheral wall sections 20 through 24 is concentrated at and around the connecting sections of the film hinge 3 and the straps 4 and 5 because the peripheral wall sections 20, 24 have a transversal cross sectional view concaved toward the center of the cap.

The elastic outward deformation of the peripheral wall sections 20 through 24 begins when the connecting sections 17, 18 and the bent section 19 of the strap 4 are elastically deformed to become substantially straight.

The shortage of distance U in FIG. 7 is compensated by the elastic outward deformation of the peripheral wall sections 20 through 24 so that the connecting section 18 of the strap 4 rotates to draw a locus of rotation R to take a position as indicated by dotted lines in FIG. 7 corresponding to the closed position of the cap 2.

As apparent from FIG. 7, the length of the straight line connecting the connecting sections 17, 18 of the strap 4 in case of the closed position of the cap 2 is slightly shorter than the length of the corresponding line when the cap 2 is in its open position. Thus, the strap 4 is laterally depressed to show a slightly sharper V-shape so that the cap 2 in the closed position is subjected to a consequent restitutive force that slightly urges it to rotate in the direction indicated by arrow Y.

The detachable engagement of the annular wall 33 of the main body section 1 and the undercut section 40 of the skirt section 6 of the cap 2 is designed to hold the cap 2 constantly in its closed position against the rotary force Y applied to the cap.

Figure 10:
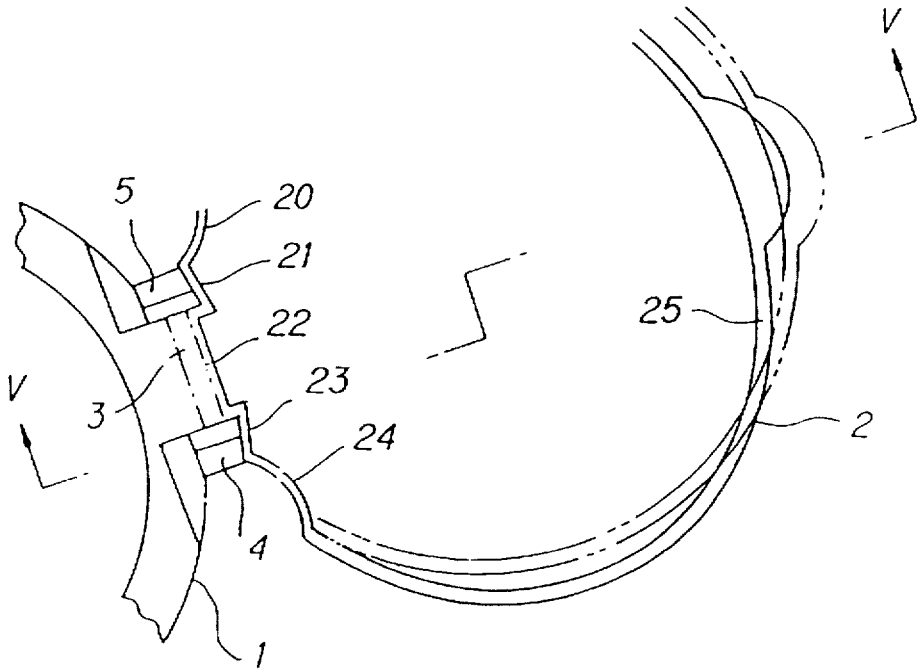
FIG. 10 is an enlarged plan view of the skirt section, schematically showing how it is elastically deformed when the cap is further swung from the position of FIG. 8.
Figure 11:
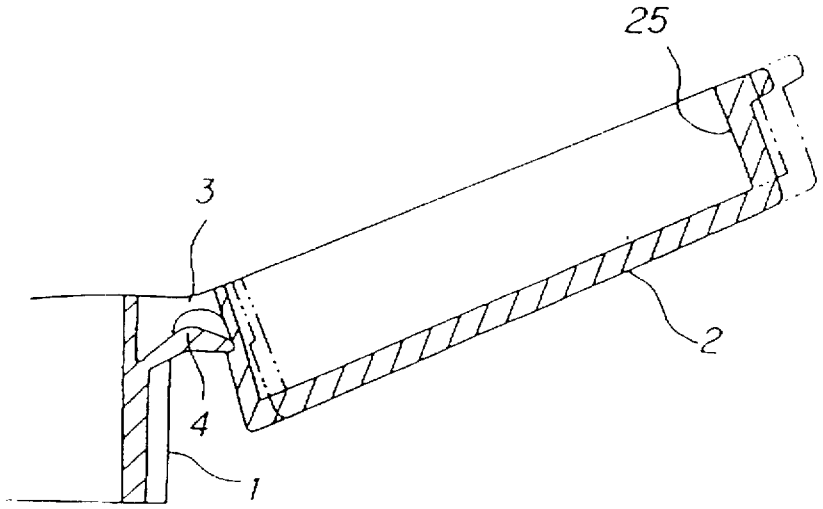
FIG. 11 is a schematic cross sectional view taken along line V—V in FIG. 10.

Since the thin peripheral wall sections 20–24 of the skirt 6 of the cap 2 is elastically deformed when the cap 2 is rotated as illustrated in FIGS. 8 and 9, such elastic deformation of the thin peripheral wall sections 20–24 pulls the remaining wall section 25 having a thicker thickness toward the main body section 1 as illustrated in FIGS. 10 and 11, so that the skirt section 6 becomes slightly elliptic as a whole.

The above described deformation is maximixed when the cap 2 is rotated or swung by an angle equal to a ½ of the total rotating or swingable angle; Thus, the snapping effect of the cap is generated.

Note that the dotted lines in FIGS. 8, 9, 10 and 11 show the position of the peripheral wall of the skirt section before it is elastically deformed.

While the main body section of the illustrated embodiment is engaged with the cylindrical neck 28 of the liquid container by press fitting, it may alternatively be engaged with the neck by screw fitting. Alternatively, the snap-hinged cap may have an elliptic or angular cross section depending on the profile of the neck. The container main body having an opening may be used as the main body section of a snap-hinged cap according to the invention. The present invention is not limited to the construction illustrated in the drawings.

Figure 12:
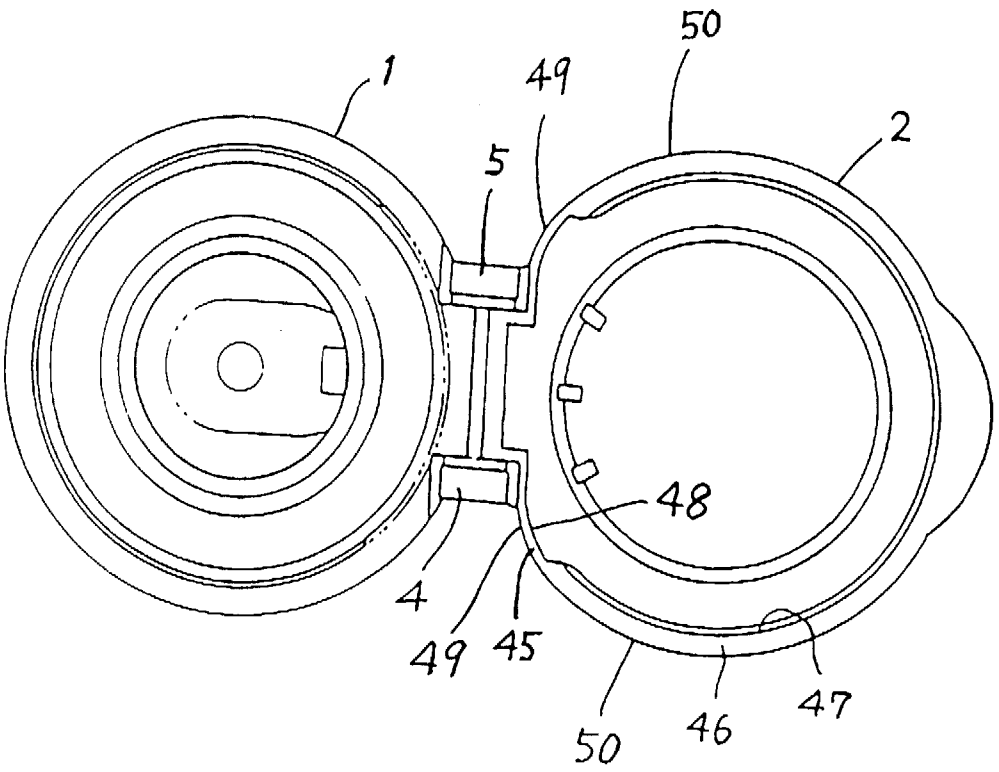
FIG. 12 is an enlarged plan view of a second embodiment of the invention with a cap in its open position.
Figure 13:
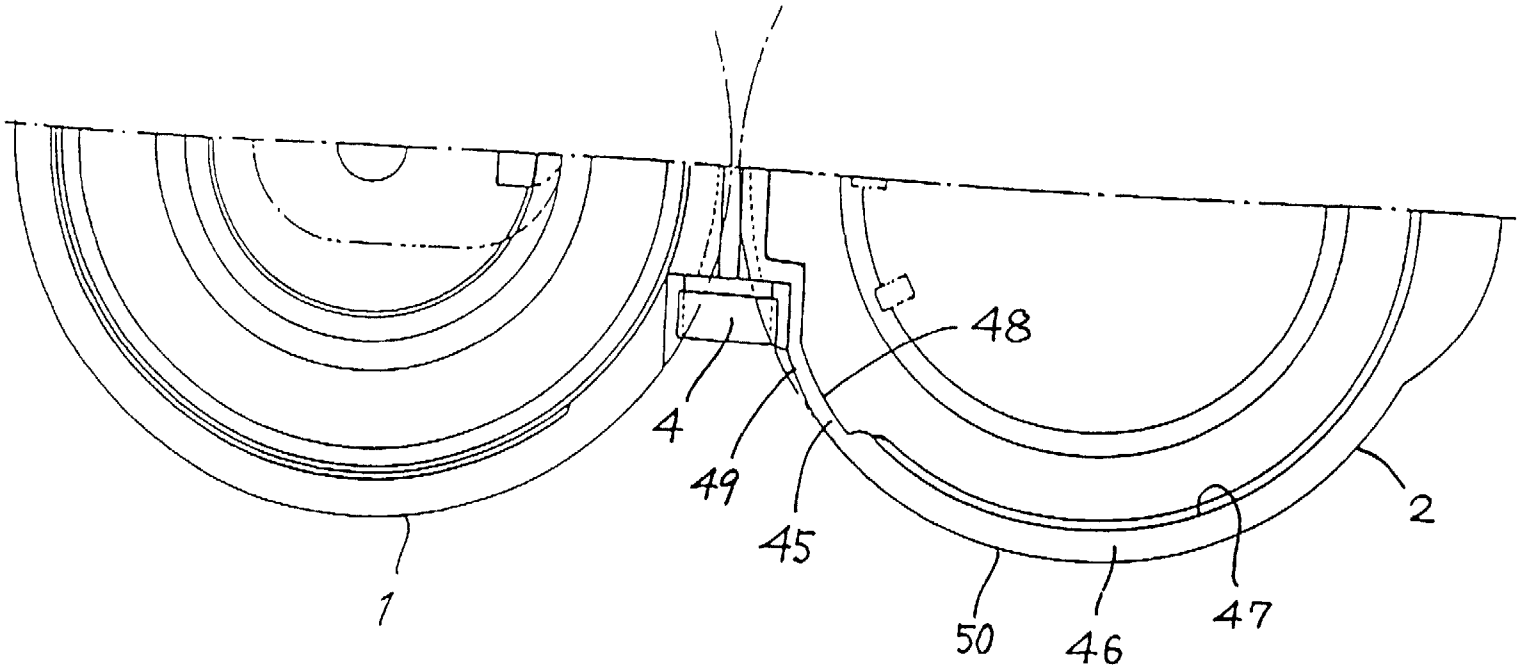
FIG. 13 is an enlarged plan view of a half of the embodiment of FIG. 12.
Figure 14:
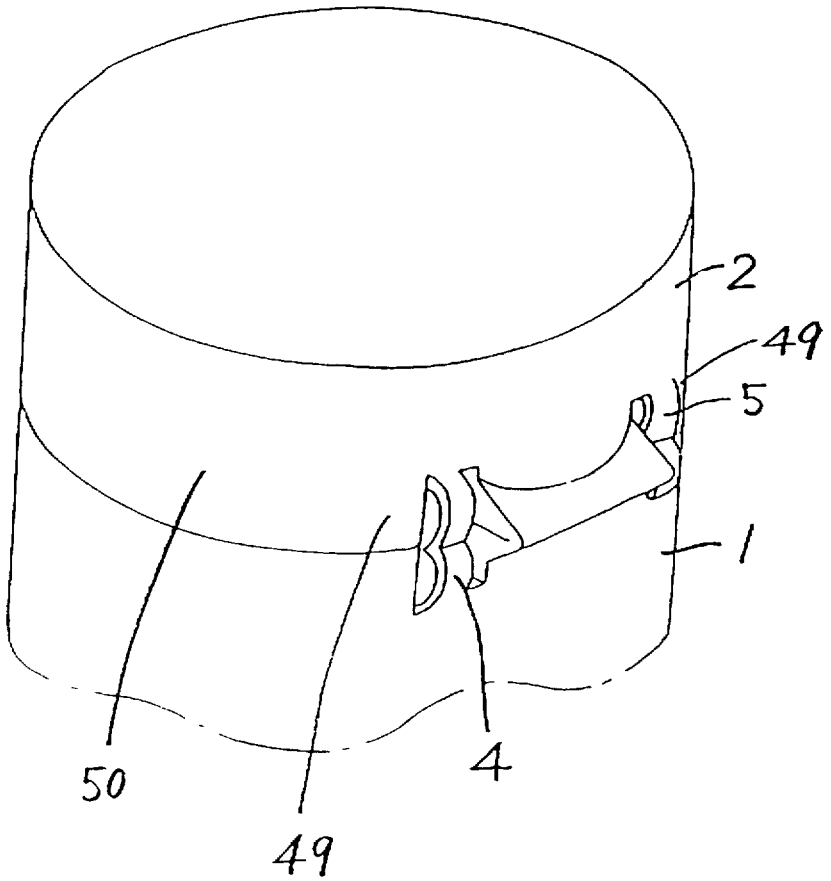
FIG. 14 is a perspective view of the cap of FIG. 12 in its closed position.

FIGS. 12, 13 and 14 illustrate a second embodiment of the invention, although the profile and the dimensions are not limited to the those of the drawings.

In the first embodiment illustrated in FIG. 1, the peripheral wall sections 20, 24 located near the respective straps 4, 5 have a transversal cross sectional view concaved toward the center of the cap. On the other hand, the second embodiment differs from the first embodiment as described below. In the second embodiment, the cap 2 has a skirt section 46. The skirt section 46 has an inner peripheral wall 47. The skirt section 46 comprises a thin portion 45 near the straps 4, 5 and a remaining portion. The thin portion 45 comprises an inner peripheral wall 48 having a transversal cross sectional view convexed outwardly and formed on the inner peripheral wall 47 of the the skirt section 46, and an outer peripheral surface 49.

The outer peripheral surface 49 of the thin portion 45 is continuously and smoothly extending from an outer peripheral surface 50 of the remaining portion of the skirt section 46 to produce a unitary-outer peripheral surface.

In other words, the second embodiment has the same construction and effect as that of the first embodiment except the construction of the outer peripheral surface 49 of the thin portion 45 is continuously and smoothly extending from the outer peripheral surface 50 of the remaining portion to produce a unitary outer peripheral surface of the skirt section as illustrated in FIG. 14.

Since the outer peripheral surface 49 and the outer peripheral surface 50 form a unitary outer peripheral surface according to the second embodiment, the second embodiment provides a good appearance. In addition, the hinged-snap cap is rolled in a conveying operation using a hopper more smoothly compared to the first embodiment so as to enhance the rate of conveying operation.

Figure 15:
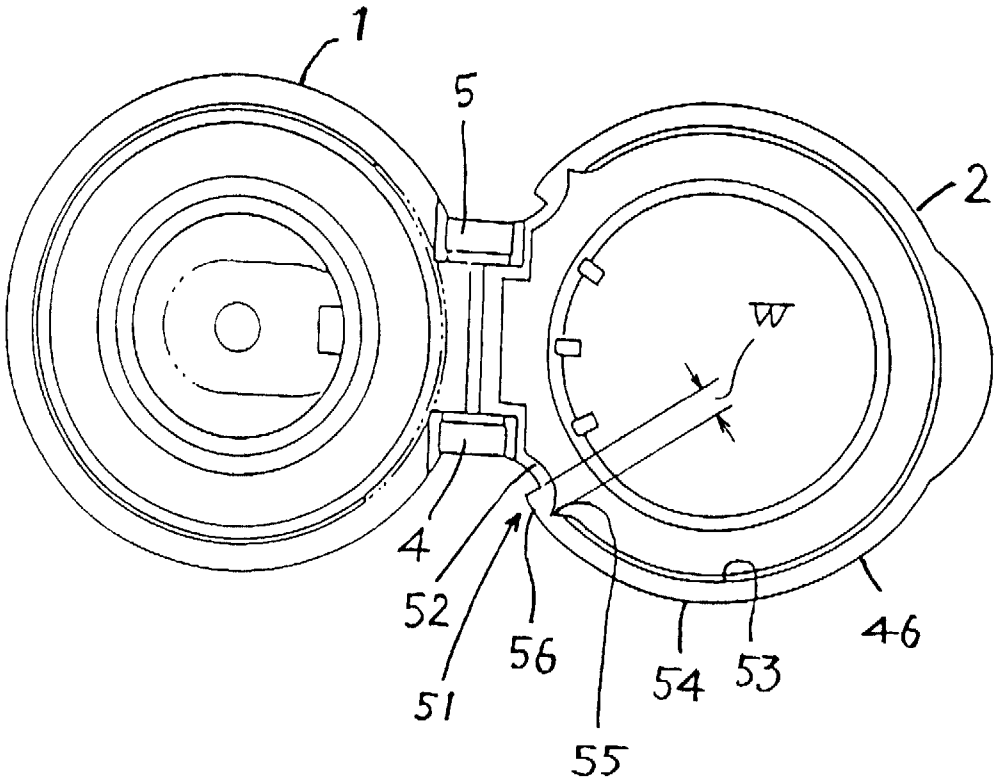
FIG. 15 is an enlarged plan view of a third embodiment of the invention with a cap in its open position.
Figure 16:
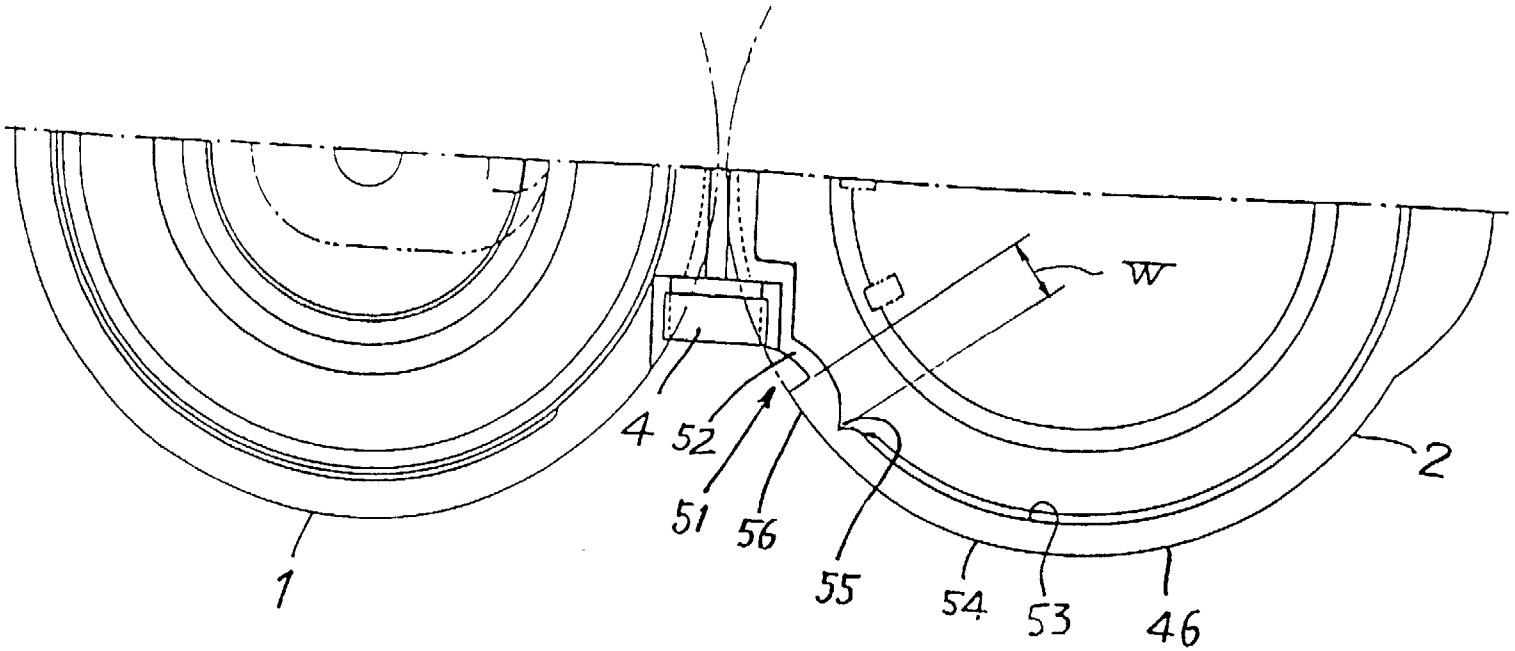
FIG. 16 is an enlarged plan view of a half of the embodiment of FIG. 15.
Figure 17:
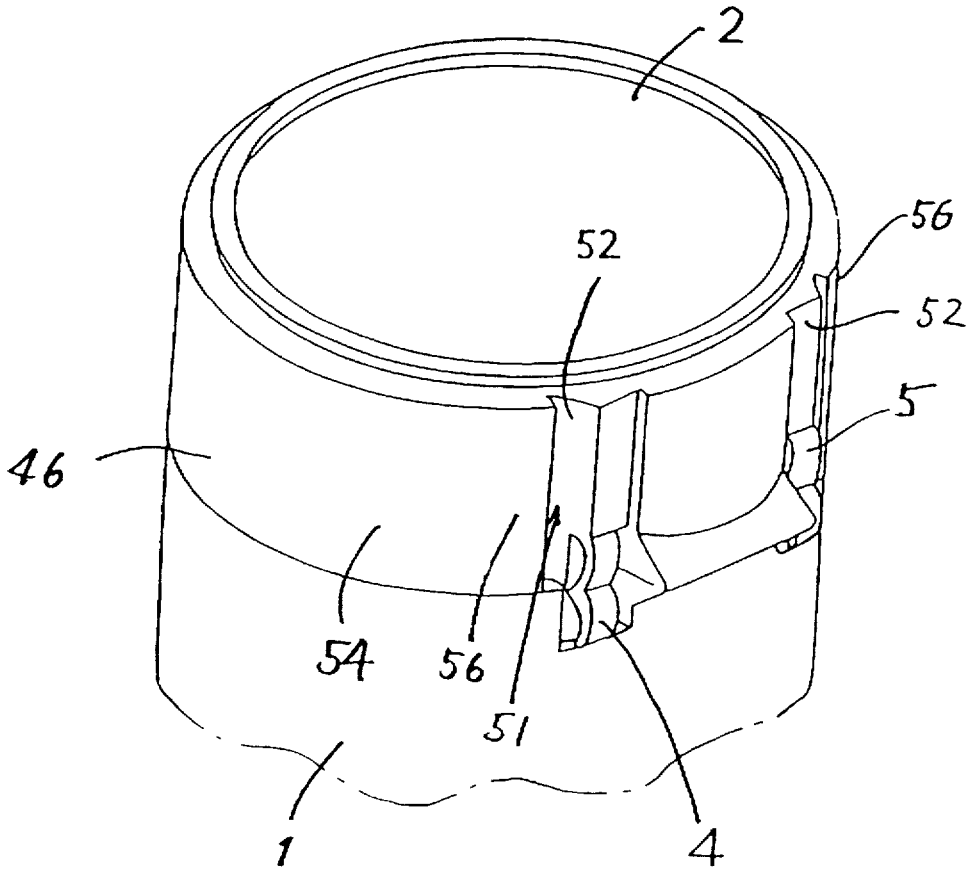
FIG. 17 is a perspective view of the cap of FIG. 15 in its closed position.
Figure 18:
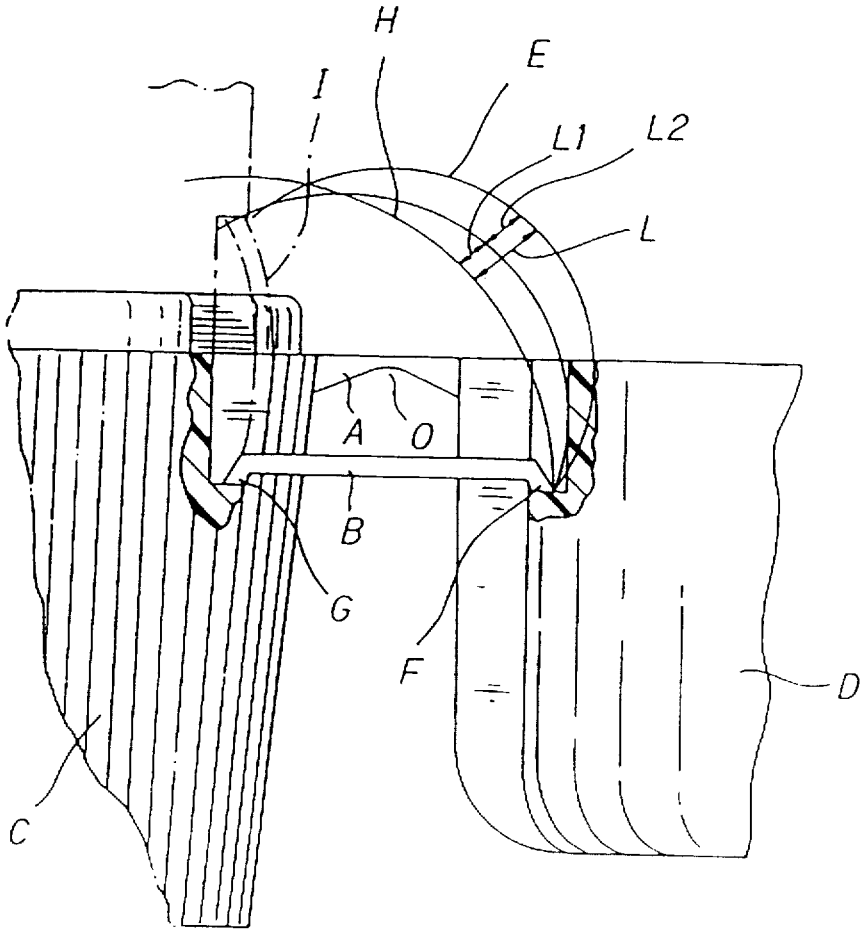
FIG. 18 PRIOR ART
FIG. 18 is an illustration showing loci of straps of a conventional snap-hinged cap.

FIGS. 15, 16 and 17 illustrate a third embodiment of the invention, although the profile and the dimensions are not limited to the those of the drawings.

The third embodiment differs from the above first and second embodiments as follows. The skirt section 46 includes a thin portion 51 near the straps 4, 5. The skirt section 46 has an inner peripheral surface 53. The thin portion 51 includes a thin peripheral wall section 52 which has a transversal cross sectional view concaved toward the center of the cap 2, and a notch 55 provided opposite to the straps 4, 5 relating to the thin peripheral wall section 52. In other words, the notch 55 is positioned away from the thin peripheral wall section 52 by a small distance W. The notch 55 is cut into the skirt section 46 from the inner peripheral surface 53 toward the outer peripheral surface 54. The thin portion 51 includes an outer peripheral surface 56 between the thin peripheral wall section 52 and the notch 55.

The third embodiment has the same construction and effect as that of the first and second embodiments except for the construction of the thin portion 51.

In this third embodiment, the thin portions 51 of the skirt section has the outer peripheral surface 56 which is continuously and smoothly extending from the outer peripheral surface 54 of the skirt section 46. Thus, according to the third embodiment, the entire length of the outer peripheral surface of the skirt section is made longer than that of the first embodiment, so that the cap provides a good appearance. In addition, since the third embodiment has continuously and smoothly outer peripheral surface compared to the first embodiment, the hinged-snap cap is rolled in a conveying operation using a hopper more smoothly compared to the first embodiment.

In addition, the thin portion 51 between the thin peripheral wall section 52 and the notch 55 has a thickness thicker than that of the first and second embodiments, the resiliency can be improved compared to the first and second embodiments.

According to the invention, since the snap effect of the cap during the opening and closing motion of the cap is realized by the elastic resiliency produced as a result of elastic deformation of the straps and that of the peripheral walls of the skirt section of the cap having a reduced thickness and therefore the straps are practically-not subjected to tensile force, the straps are made free from degradation in the strength to prolong the service life of the snap-hinged cap.

Since the bent sections of the straps project toward the central axis of the cap when the cap is closed, the portions of the straps projecting outward from the outer peripheral surface of the snap-hinged cap can be dimensionally minimized to improve the appearance of the snap-hinged cap.

Since the straps show large elastic resiliency after elastic deformation, they can produce a good snap effect.

Since each of the portions of the skirt section of the cap formed outside the straps comprises a peripheral wall section that can be easily and elastically deformed, the straps can be effectively prevented from being subjected to external tensile force.

Since each of the portions of the skirt section of the cap formed outside the straps and having a reduced thickness comprises an outer peripheral surface continuously and smoothly extending from the outer peripheral surface of the remaining portion of the skirt section, the snap-hinged cap provides a good appearance and can adapt itself stably to bottling operation in a bottling line using a hopper to enhance the rate of bottling operation.

Since each of the portions of the skirt section of the cap formed close to the straps and having a reduced thickness makes the outer peripheral surface of the cap transversally long to a certain extent, the snap-hinged cap can adapt itself more stably to bottling operation in a bottling line and the resiliency of the portions of the skirt section having a reduced thickness can be improved to some extent. Additionally, an outer peripheral surface provided between the peripheral wall showing a convexed cross sectional view and the notch of each of said portions having a reduced thickness improves the resiliency of those portions to some extent.

Since only a couple of members project by a short distance from the outer peripheral surface of the cylindrical container comprising a main body section and a cap as integral components when the cap is in its closed position, the container can adapt itself excellently to packaging operation using thin film.

The skirt section is elastically deformed to absorb and dissipate external tensile force applied to the straps and eliminate any tensile stress in the straps at an angular position of the cap where the straps are maximally expanded to improve the service life of the straps.

What is claimed is:

1. A snap-hinged cap comprising a main body section of thermoplastic synthetic resin, a cap integrally molded with the main body section, a film hinge connecting the main body section and the cap, and straps arranged on both lateral sides of the film hinge, wherein said cap includes a skirt section which includes a lower edge;

said main body section includes a peripheral wall;

said film hinge connects a portion of the lower edge of the skirt section of the cap and a portion of the peripheral wall of the main body section;

said straps are connected to the main body section and the cap at connecting sections, said connecting sections being arranged above and below an abutting surface of the lower edge of the skirt section of the cap and the main body section when the cap is closed;

each of said straps having an axially-extending; centrally-located center line longer than a straight line between said connecting sections for a given strap; and said skirt section of the cap having a peripheral wall of differential thickness, the peripheral wall having a thin portion which extends from the film hinge to a location beyond said straps.

2. The snap-hinged cap according to claim 1, wherein each of the straps has a compressed V-shape and a bent section;

the bent section is projected toward a center of the cap when the cap is closed; and the bent section is projected upwardly when the cap is opened.

3. The snap-hinged cap according to claim 2, wherein each of the straps has a maximum thickness at the bent section of the compressed V-shape.

4. The snap-hinged cap according to claim 1, wherein said thin portion comprises at least one concave portion extending radially-inward toward a center of the cap.

5. The snap-hinged cap according to claim 1, wherein said thin portion comprises at least one convex portion extending radially-outward away from a center of the cap, the convex portion forming a portion of an outer peripheral surface of the skirt section, the outer peripheral surface of the skirt section being smooth and continuous.

6. The snap-hinged cap according to claim 1, wherein said thin portion comprises at least one concave portion extending radially-inward toward a center of the cap and at least one notch located near said location beyond at least one of said straps.

7. The snap-hinged cap according to claim 1, wherein the peripheral wall of the main body section has a cylindrical shape;

the skirt section of the cap has a cylindrical shape; and connecting portions of the hinge and the skirt section, an axis of rotating motion of the film hinge, and the thin portion of the peripheral wall of the cap are arranged near an imaginary extended surface of the peripheral wall and an imaginary extended surface of a thicker peripheral wall portion of the skirt section.

8. The snap-hinged cap according to claim 7, wherein when the cap is opened and closed, the thin peripheral wall portion is elastically deformed to prevent the film hinge and the straps from being subjected to concentrated tensile stress.

* * * * *